United States Patent [19]

Holz

[11] Patent Number: 4,619,737

[45] Date of Patent: Oct. 28, 1986

[54] ROLLER FOR MACHINES IN THE PAPER-MAKING INDUSTRY

[75] Inventor: Emil Holz, Eningen, Fed. Rep. of Germany

[73] Assignee: Hermann Finckh Maschinenfabrik GmbH & Co., Fed. Rep. of Germany

[21] Appl. No.: 773,361

[22] Filed: Sep. 6, 1985

[30] Foreign Application Priority Data

Sep. 29, 1984 [EP] European Pat. Off. ..... 84111680.9

[51] Int. Cl.[4] ..... D21F 1/60; D21F 1/46

[52] U.S. Cl. ..... 162/357; 29/121.3; 162/372; 210/402

[58] Field of Search ..... 162/357, 372; 29/121.3, 29/121.2; 210/402, 404

[56] References Cited

U.S. PATENT DOCUMENTS

| | | | |
|---|---|---|---|
| 2,240,869 | 5/1941 | Specht | 162/357 |
| 3,564,686 | 2/1971 | Bryand | 162/372 |
| 3,590,453 | 7/1971 | Bryand | 162/372 |
| 3,829,360 | 8/1974 | Holz | 162/357 |
| 4,050,131 | 9/1977 | Bryand | 162/372 |
| 4,146,428 | 3/1979 | Holz | 162/357 |

FOREIGN PATENT DOCUMENTS

| | | |
|---|---|---|
| 3210320 | of 1983 | Fed. Rep. of Germany . |
| 2155344 | of 1973 | France . |
| 2399504 | of 1979 | France . |
| 2123862 | of 1984 | United Kingdom . |
| 2123863 | of 1984 | United Kingdom . |

*Primary Examiner*—S. Leon Bashore
*Assistant Examiner*—K. M. Hastings
*Attorney, Agent, or Firm*—Leydig, Voit & Mayer

[57] ABSTRACT

Roller for machines in the paper-making industry or similar, with a honeycomb-shaped roller element formed by upright straight and corrugated bands, extending approximately in the circumferential direction and alternating with each other in the axial direction, said bands being connected by welded joints. To make passages, which allow a throughflow in the circumferential direction, between the roller element and a fabric cover supported by the latter, openings adjoining the fabric cover are provided in the roller element between the fabric cover and the radially outer edges of the corrugated bands in the area of the connecting points and in the center between the connecting points, and in order to increase the open-passage area of the fabric cover, the latter rests directly on the roller element.

5 Claims, 8 Drawing Figures

ROLLER FOR MACHINES IN THE PAPER-MAKING INDUSTRY

Figure 1:
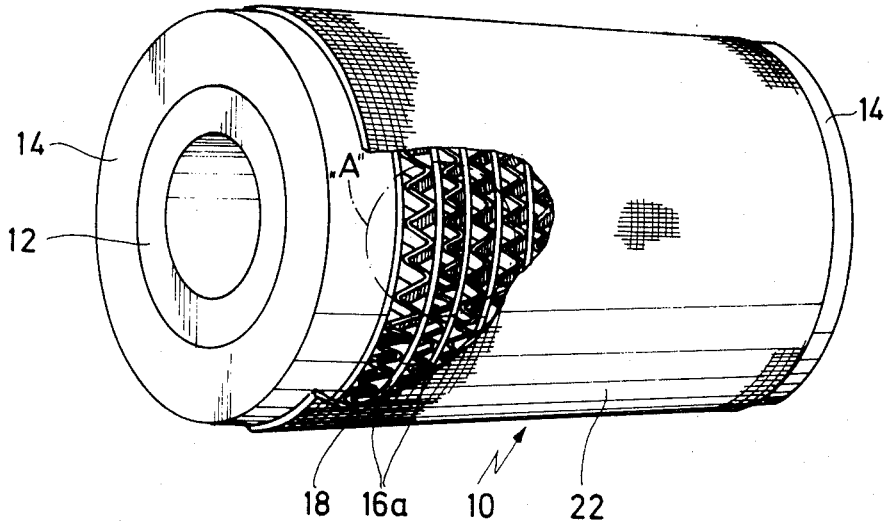

The invention relates to a roller for machines in the paper-making industry or similar, in particular a sheet-forming roller, such as a cylinder mould, a forming roller or a couch roller, with a support tube on which are attached several bands extending at least approximately in the circumferential direction and standing upright in the radial direction, wherein straight and corrugated band sections alternate with each other in the axial direction and the straight band sections are connected together by the corrugated band sections at connecting points, said corrugated band sections having recesses at their radially outer edges, and also with a cover fabric which forms the circumference of the roller and is supported at least on the corrugated band sections, and with passages provided between said cover fabric and the bands at the connecting points of the latter in the region of the radially outer edges of the corrugated band sections said passages allowing a throughflow in the circumferential direction.

Such a roller, but without a support tube, is known from DE-AS No. 21 48 361 (U.S. Pat. No. 3,829,360). With this roller, the straight and corrugated bands are of the same height in the radial direction, and, to prevent a scoop-like action, the corrugated band sections are provided at the connecting points on their radially outer edges with recesses which allow a throughflow in the circumferential direction; without these recesses, acutely-angled pockets would form at the connecting points between the straight and the corrugated band sections, whereby, owing to the cover fabric being supported on the outer edges of the bands, pulp-water accumulations would occur in the aforementioned pockets when the rotating roller dips into the wet paper web. If, with the known roller, the cover fabric were to rest directly on the outer edges of the bands, the recesses in the corrugated bands, however, would still not suffice to prevent disadvantageous accumulations of water at the outer edges of the corrugated bands. The known roller, therefore, also has an underlay fabric between the bands and the cover fabric. This, however, not only makes the production of the roller more expensive, but also entails a considerable number of additional disadvantages: it reduces the open-passage area at the roller circumference, increases the risk of the cover fabric becoming dirty and adversely affects the trueness of the roller.

The object of the invention, therefore, was to improve the known roller in such a way that it is possible to dispense with the underlay fabric, which, according to the invention, can be achieved in that the corrugated band sections comprise additional recesses at their radially outer edges approximately in the center between the connecting points, and that the cover fabric rests directly at least on the corrugated band sections. The additional recesses in the corrugated band sections allow not only an additional throughflow in the circumferential direction between the cover fabric and the band sections supporting the latter, but they also reduce the total support surface for the cover fabric and thus, just like the dispensing with the underlay fabric, contribute towards increasing the total open-passage area at the roller circumference, without thereby adversely affecting the quality of support of the cover fabric. With the roller according to the invention, the cover fabric runs a smaller risk of becoming dirty, and finally, owing to the absence of the underlay fabric, the roller has greater trueness than the known roller described.

In a preferred embodiment, the corrugated band sections project beyond the straight band sections in the radial direction, thus creating at the connecting points between the corrugated band sections and the cover fabric passages which allow a throughflow in the circumferential direction. With such a design, the straight bands may be made thicker, since this does not increase the effective support surface for the cover fabric, and consequently does not reduce the total open-passage area at the roller circumference. Furthermore, thicker straight band sections lead to wider passages for a throughflow in the circumferential direction. With rollers for particularly high pressure loads it is recommended, however, that the corrugated and the straight band sections be arranged such that they have the same outside diameter, and that the corrugated and/or the straight band sections are provided with recesses at the connecting points at their radially outer edges in order at the connecting points to create passages which allow a throughflow in the circumferential direction.

In a preferred embodiment of the roller according to the invention, the straight bands form closed rings which are shrunk onto the support tube. It is then recommended that the corrugated bands be arranged at a radial distance from the support tube such that the straight band sections project inwards in the radial direction beyond the corrugated band sections and are seated on the support tube, and that the straight band sections are provided with recesses at their radially inner edges in order to equalize the pressure between the individual ring channels between the straight bands.

Figure 2:
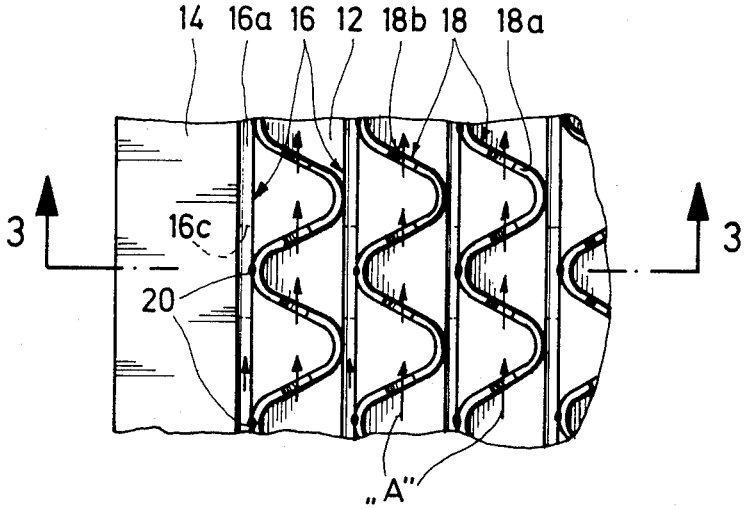
Figure 3:
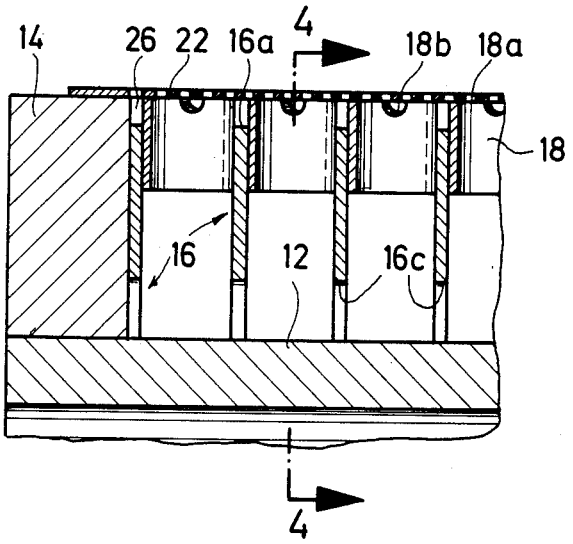
Figure 4:
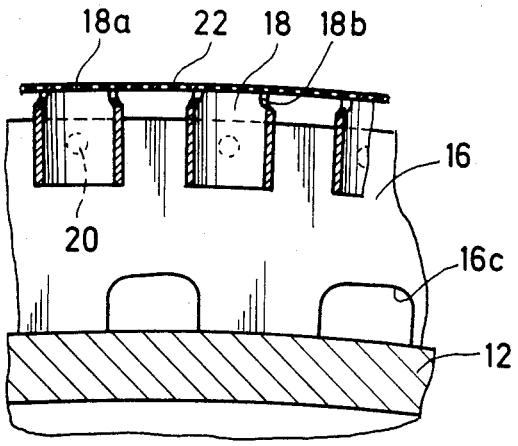
Figure 5:
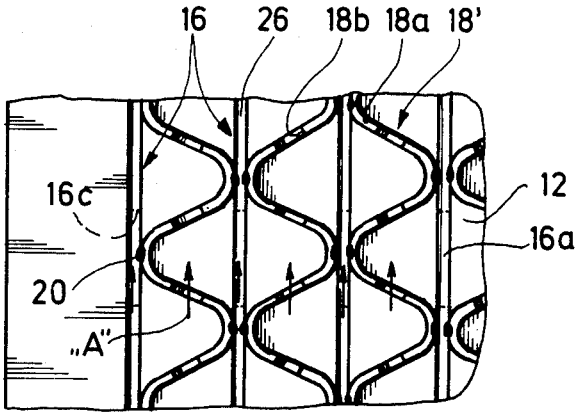
Figure 6:
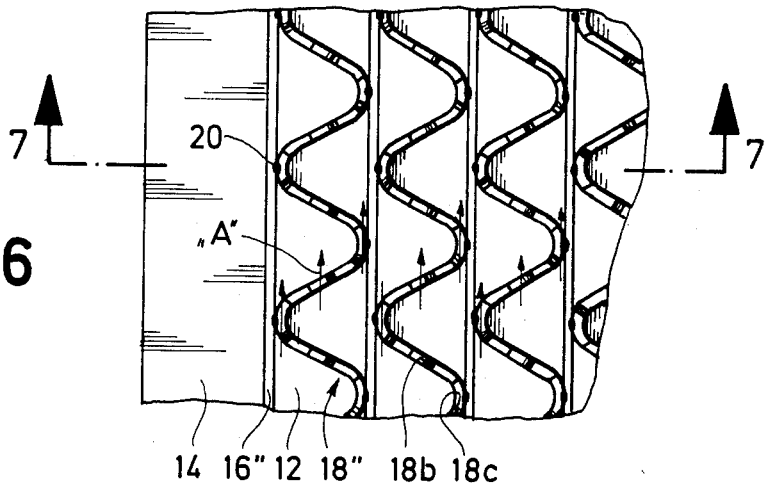
Figure 7:
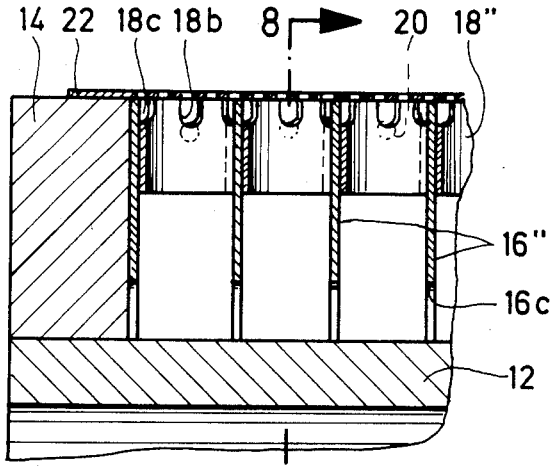
Figure 8:
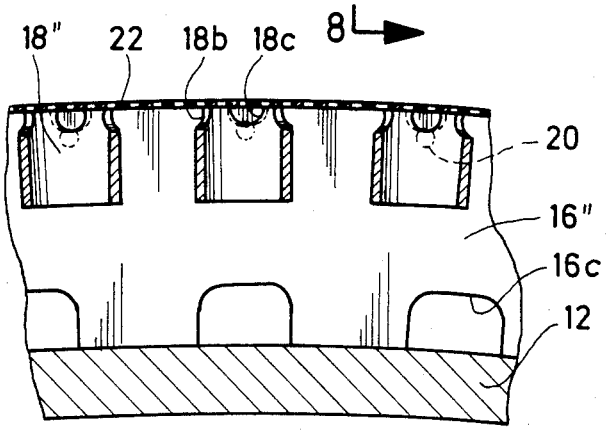

Further features, advantages and details of the invention can be seen from the attached claims and/or from the following description, as well as from the attached drawings of two preferred embodiments of the roller according to the invention; in the drawings are shown:

FIG. 1 a graphical representation of the roller with the fabric cover partially removed;

FIG. 2 the enlarged detail "A" from FIG. 1;

FIG. 3 a section on line 3—3 in FIG. 2 through the left-hand end region of the roller as shown in FIG. 1;

FIG. 4 a section on line 4—4 in FIG. 3;

FIG. 5 a representation of the second embodiment corresponding to FIG. 2;

FIG. 6 a representation of a third embodiment corresponding to FIGS. 2 and 5;

FIG. 7 a section corresponding to FIG. 3 through the third embodiment on line 7—7 in FIG. 6; and FIG. 8 a section on line 8—8 in FIG. 7.

FIG. 1 to 4 show a roller 10 with a circular cylindrical support tube 12, preferably made of stainless steel, at the ends of which are attached end rings 14. The support tube 12 also bears circular ring-shaped straight bands 16 arranged at an axial distance from each other and shrunk onto the support tube; ring-shaped corrugated bands 18 are welded between the latter bands. With the embodiment shown in FIG. 1 to 4, the corrugated bands 18 project beyond the straight bands 16, and their radially outer edges align with each other as well as with the outer circumferential surface of the end rings 14. Conversely, the corrugated bands 18 terminate at a radial distance from the support tube 12. The welded joints at which the bands 16 and 18 are attached to each other are designated by 20. A fabric cover 22 rests directly on the radially outer edges of the corrugated bands 18 and on the end rings 14, forming a closed circular cylinder.

By the radially outer edges 16*a* of the straight bands being set back with respect to the radially outer edges 18*a* of the corrugated bands, passages 26 are formed directly inside the fabric cover 22 between the latter and the edges 16*a* of the straight bands as well as between the corrugated bands 18, said passages allowing a throughflow in the circumferential direction. The effect of these passages is particularly advantageous when adjacent corrugated bands are offset with respect to each other by half the length of a corrugation in the circumferential direction, as is the case with the corrugated bands 18' of the embodiment shown in FIG. 5.

The open-passage area of the fabric cover 22 which has already been increased by the straight bands 16 being set back can be still further increased by center recesses 18*b* in the area of the radially outer edges 18*a* of the corrugated bands 18 or 18', thus producing between the fabric cover 22 and the bands supporting the latter more passages which permit a throughflow in the circumferential direction of the roller, as has been illustrated with arrows A in FIG. 2 and 5. At the same time these recesses 18*b* reduce still further the risk of water accumulations—which adversely affect the sheet-forming process during paper production—occurring at the radially outer edges of the bands supporting the fabric cover.

Finally, the straight bands 16 are provided with openings 16*c* which in particular adjoin the support tube 12 and serve the following purpose: since the support tube 12 forms a roller element closed at its circumference, onto which roller element is shrunk the honeycomb structure supporting the fabric cover, the equalization of pressure between the ring channels between the straight bands 16 must be ensured—in the event of the fibre suspension flowing onto the sheet-forming roller in the radial direction from outside during sheet-forming, it must be possible for air to escape out of the above-mentioned ring channels in the circumferential direction of the roller; without the openings 16*c*, it would be possible at the same time for differences in pressure to develop between the ring channels, thus preventing the uniform formation of the sheets.

Since in the embodiments shown in FIG. 1 to 5 the fabric cover 22 is not directly supported by the straight bands 16, thicker metal may be chosen for these bands. Furthermore, with the embodiments shown in FIGS. 1 to 5 it is possible to create open-passage areas of the fabric cover 22, whereby these areas may be equal to up to 93% of the total fabric cover area.

The third embodiment shown in FIG. 6 to 8 differs from the embodiment shown in FIG. 1 to 4 only in that the radially outer edges of the straight bands 16'' align with the radially outer edges of the corrugated bands 18'' and the outer circumferential surface of the end rings 14, and in that, in place of the passages 26, recesses 18*c* have been provided in the corrugated bands 18'' in the area of the connecting points 20. The embodiment shown in FIG. 6 to 8 is suitable particularly for such rollers in which the fabric cover is exposed to a high pressure load. However, in order to make the open-passage area of the fabric cover as big as possible (with this embodiment, it may be equal to up to 90% of the total area of the fabric cover), it is recommended that for the straight bands 16'' metal of smaller thickness or at most of equal thickness be chosen than for the corrugated bands 18''.

Just as with the roller according to DE-AS No. 21 48 361, the axially consecutive straight and corrugated band sections, however, could also be formed by one or more straight or corrugated bands extending helically around the support tube 12.

What is claimed is:

1. A roller for machines in the paper-making industry, said roller comprising a support tube, a plurality of bands attached to the support tube and extending at least approximately in the circumferential direction and standing upright in the radial direction, said bands including straight and corrugated band sections alternating with each other in the axial direction and connected one to another at connecting points, said corrugated band sections having recesses at their radially outer edges approximately in the center between the connectiong points, and a cover fabric forming the circumference of the roller and supported and resting directly on at least the radially outer edges of the corrugated band sections with passages provided between the cover fabric and the bands at the connecting points of the latter in the region of the radially outer edges of the corrugated band sections, said passages allowing a through flow in the circumferential direction.

2. Roller as defined in claim 1, wherein the corrugated band sections project in the radial direction beyond the straight band sections.

3. Roller as defined in claim 1, wherein the corrugated and straight band sections are of the same outside diameter and at least one of the straight band sections comprise recesses on their radially outer edges at the connecting points.

4. Roller as defined in claim 1 wherein the straight band sections project inwards in the radial direction beyond the corrugated band sections and are seated on the support tube and comprise recesses on their radially inner edges.

5. Roller as defined in claim 1, wherein neighbouring corrugated band sections are offset with respect to each other by half the length of a corrugation in the circumferential direction.

* * * * *